US006408721B1

(12) United States Patent
Lee

(10) Patent No.: US 6,408,721 B1
(45) Date of Patent: Jun. 25, 2002

(54) WRENCH HAVING A RETRACTABLE HANDLE

(76) Inventor: Jack Lee, No. 53, Nan Shi Keng, Da Nan Village, Mei Shan Hsiang, Jia Yi Hsien (TW)

( * ) Notice: Subject to any disclaimer, the term of this patent is extended or adjusted under 35 U.S.C. 154(b) by 0 days.

(21) Appl. No.: 09/584,023

(22) Filed: May 30, 2000

(51) Int. Cl.[7] ..... B25B 13/46; B25B 23/16
(52) U.S. Cl. ..... 81/60; 81/177.2
(58) Field of Search ..... 81/177.2; 403/107, 403/377, 328, 325; 279/75

(56) References Cited

U.S. PATENT DOCUMENTS 2,592,978 A * 4/1952 Trimbol ..... 81/177.2 X
3,424,212 A * 1/1969 Kemper ..... 81/177.2 X
3,813,967 A * 6/1974 De Haven ..... 81/177.2 X
4,290,617 A * 9/1981 Yoshida ..... 279/75
4,586,406 A * 5/1986 Howard ..... 81/177.2
5,471,899 A * 12/1995 Twomlow ..... 81/60
6,089,133 A * 7/2000 Liao ..... 81/177.2 X

* cited by examiner

*Primary Examiner*—D. S. Meislin
(74) *Attorney, Agent, or Firm*—Charles E. Baxley, Esq.

(57) ABSTRACT

A wrench includes a wrench body, an elongated shank mounted on the wrench body, an elongated retractable handle telescopically and slidably mounted on the shank, and an adjusting device mounted between the shank and the retractable handle for adjustably securing the retractable handle on the shank.

1 Claim, 5 Drawing Sheets

WRENCH HAVING A RETRACTABLE HANDLE

BACKGROUND OF THE INVENTION

1. Field of the Invention

The present invention relates to a wrench, and more particularly to a wrench having a retractable handle.

2. Description of the Related Art

A conventional wrench in accordance with the prior art includes a wrench body, and a shank extending from the wrench body for rotating the wrench body to operate a workpiece such as a nut, a bolt or the like. In general, the wrench often needs to exert a torque of different strengths for operating workpieces of different sizes. For example, the wrench usually needs a larger torque for operating a heavier workpiece, and needs a smaller torque for operating a lighter or smaller workpiece. However, the length of the shank is fixed so that the shank can only provide a torque with a fixed strength on the wrench body for operating the workpiece, thereby decreasing and limiting the versatility of the wrench.

SUMMARY OF THE INVENTION

The present invention has arisen to mitigate and/or obviate the disadvantage of the conventional wrench.

The primary objective of the present invention is to provide a wrench having a retractable handle for arbitrarily adjusting the length of arm of force of the wrench so that the wrench includes an adjustable and variable arm of force so as to provide a torque of various strengths for operating workpieces which need torque of different strengths, thereby increasing the versatility of the wrench.

In accordance with one aspect of the present invention, there is provided a wrench comprising a wrench body, an elongated shank mounted on the wrench body, an elongated retractable handle telescopically and slidably mounted on the shank, and an adjusting device mounted between the shank and the retractable handle for adjustably securing the retractable handle on the shank.

The shank has an outer periphery defining a plurality of annular retaining grooves, and the adjusting device includes an adjusting ring slidably mounted on a first end of the retractable handle and having a first end defining a receiving recess in an inner wall thereof, and a plurality of locking balls each movably mounted in the first end of the retractable handle and each detachably secured in one of the retaining grooves of the shank, wherein, the adjusting ring is slidable on the first end of the retractable handle between a first position where each of the locking balls is pressed by an inner wall of the adjusting ring to be received in one of the retaining grooves of the shank for positioning the retractable handle on the shank, and a second position where each of the locking balls is introduced into the receiving recess of the adjusting ring to detach from the one retaining groove, thereby releasing and detaching the retractable handle from the shank such that the retractable handle is slidable on the shank.

The adjusting ring includes a second end defining a chamber provided with an annular abutting flange, and the adjusting device further includes a plurality of abutting beads each secured in an outer periphery of the first end of the retractable handle and each received in the chamber of the adjusting ring, and a biasing member mounted on the retractable handle, received in the chamber of the adjusting ring and pressed between the abutting flange and the abutting beads.

Further benefits and advantages of the present invention will become apparent after a careful reading of the detailed description with appropriate reference to the accompanying drawings.

DETAILED DESCRIPTION OF THE INVENTION

Figure 1:
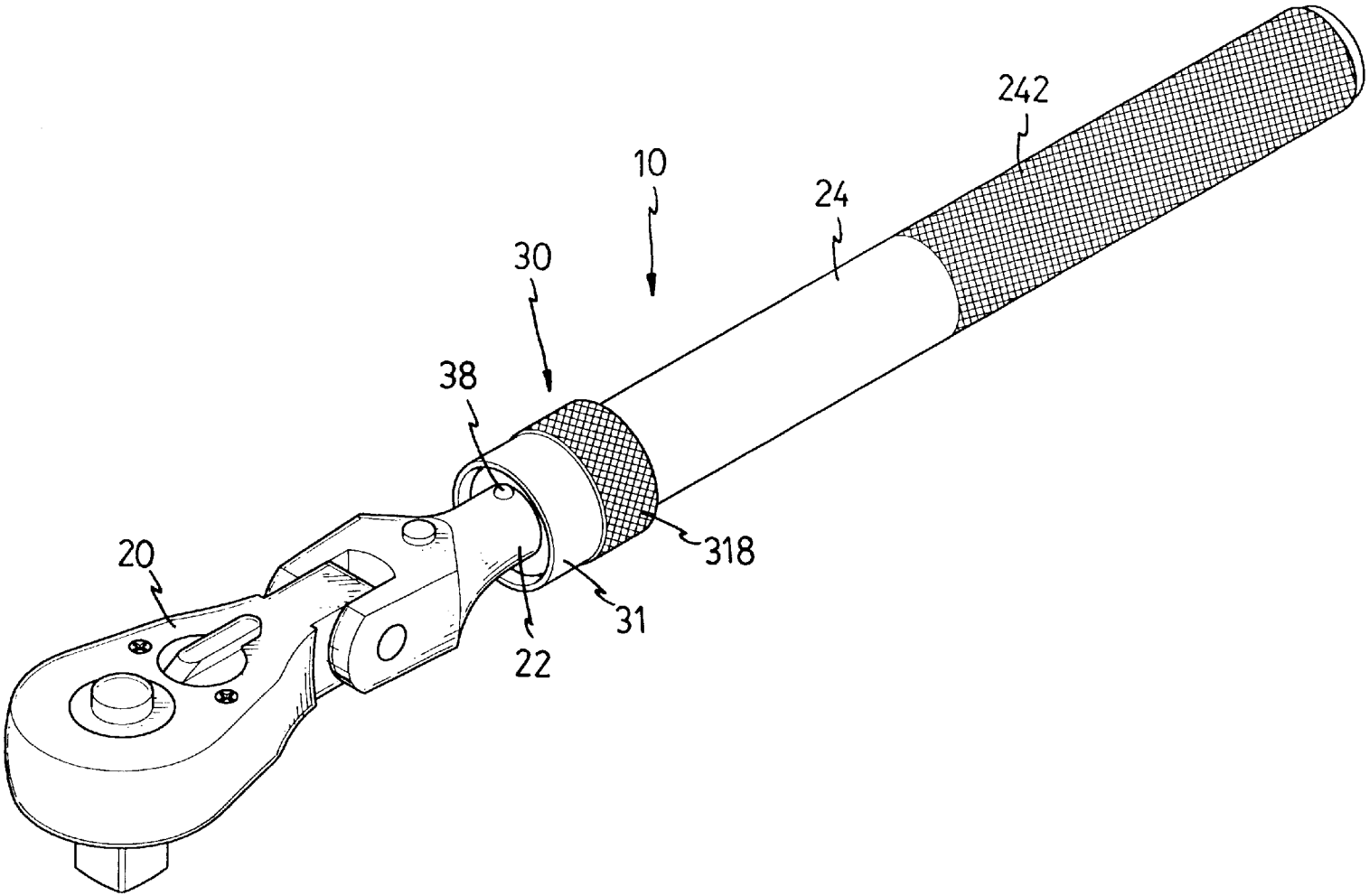
FIG. 1 is a perspective view of a wrench having a retractable handle in accordance with the present invention.
Figure 2:
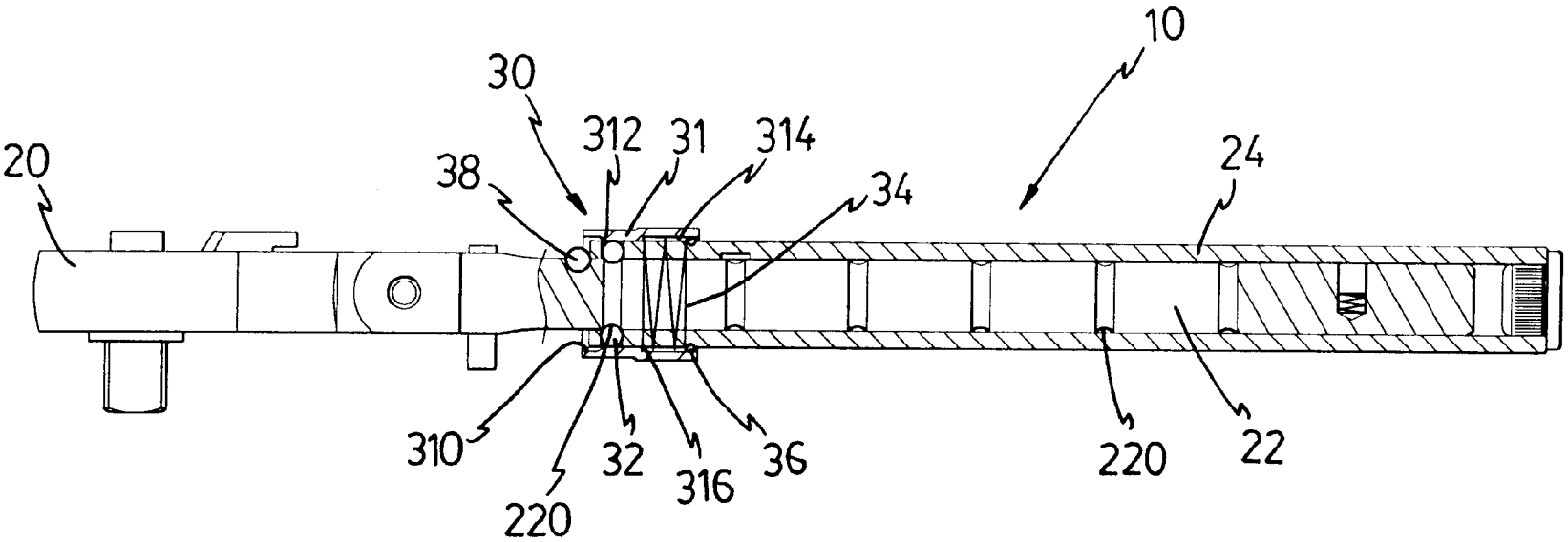
FIG. 2 is a front plan cross-sectional view of the wrench as shown in FIG. 1.
Figure 3:
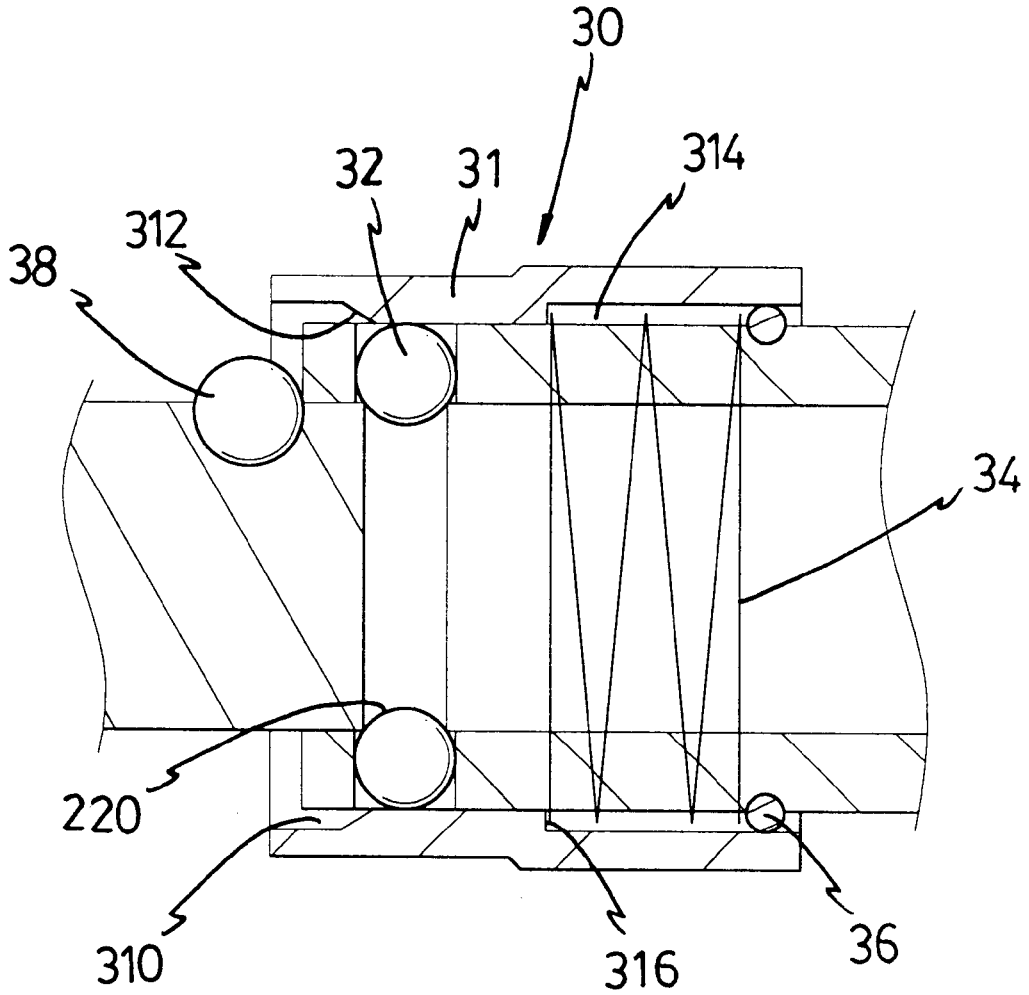
FIG. 3 is an enlarged view of the wrench as shown in FIG. 2.

Referring to the drawings and initially to FIGS. 1–3, a wrench 10 in accordance with the present invention comprises a wrench body 20, an elongated shank 22 mounted on or extending from the wrench body 20 and having an outer periphery defining a plurality of annular retaining grooves 220, an elongated retractable handle 24 telescopically and slidably mounted on the shank 22, and an adjusting device 30 mounted between the shank 22 and the retractable handle 24 for adjustably securing the retractable handle 24 on the shank 22.

The adjusting device 30 includes an adjusting ring 31 slidably mounted on a first end of the retractable handle 24 and having a first end defining a receiving recess 310 in an inner wall thereof, and a plurality of locking balls 32 each movably mounted in the first end of the retractable handle 24 and each detachably secured in one of the retaining grooves 220 of the shank 22. The receiving recess 310 of the adjusting ring 31 includes a tapered guide neck 312 for introducing each of the locking balls 32 into the receiving recess 310.

By such an arrangement, the adjusting ring 31 is slidable on the first end of the retractable handle 24 between a first position where each of the locking balls 32 is pressed by an inner wall of the adjusting ring 31 to be received in one of the retaining grooves 220 of the shank 22 for positioning the retractable handle 24 on the shank 22, and a second position where each of the locking balls 32 is introduced into the receiving recess 310 of the adjusting ring 31 to detach from the one retaining groove 220, thereby in turn releasing and detaching the retractable handle 24 from the shank 22 such that the retractable handle 24 is slidable on the shank 22.

The adjusting ring 31 includes a second end defining a chamber 314 provided with an annular abutting flange 316. The adjusting device 30 further includes a plurality of abutting beads 36 each secured in an outer periphery of the first end of the retractable handle 24 and each received in the chamber 314 of the adjusting ring 31, and a biasing member 34, such as a spring, mounted on the retractable handle 24, received in the chamber 314 of the adjusting ring 31 and pressed between the abutting flange 316 and the abutting beads 36.

The adjusting device 30 further comprises a limiting ball 38 secured in the shank 22 and abutting the first end of the retractable handle 24 for limiting the first end of the retractable handle 24.

Preferably, the adjusting ring 31 includes a knurl 318 formed on an outer periphery thereof, and the retractable handle 24 includes a knurl 318 formed on an outer periphery thereof.

Figure 4:
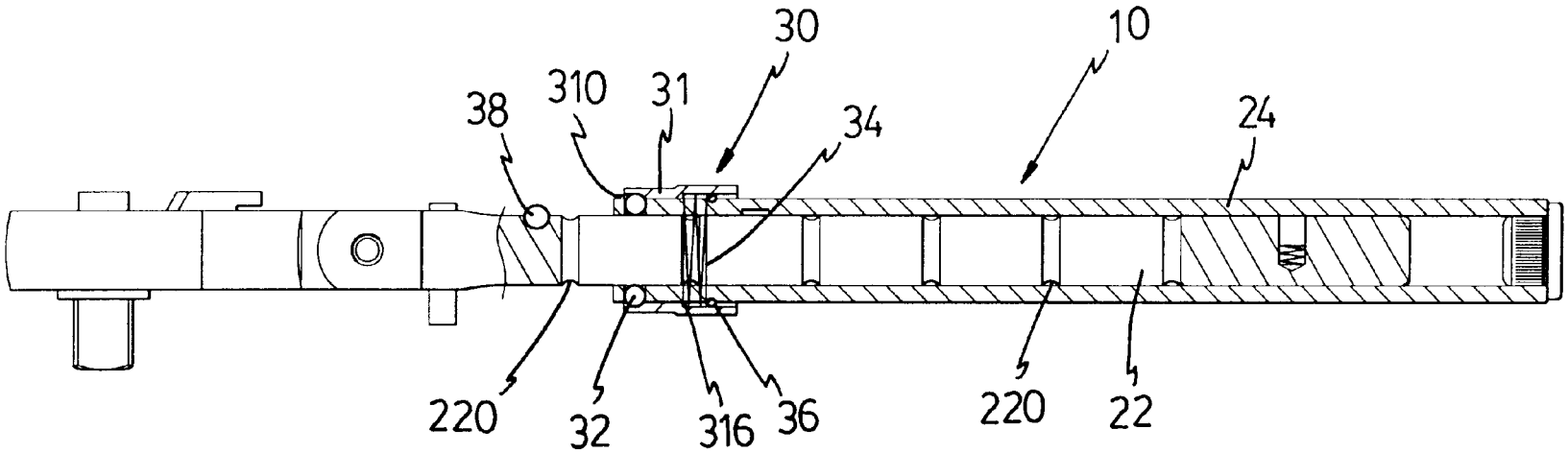
FIG. 4 is an operational view of the wrench as shown in FIG. 2.
Figure 5:
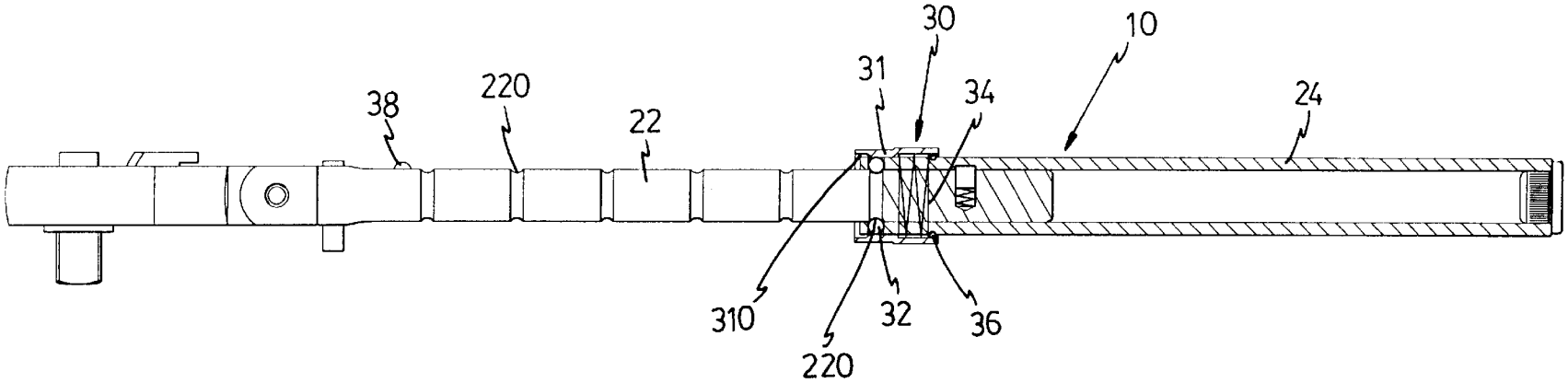
FIG. 5 is an operational view of the wrench as shown in FIG. 2.

In operation, referring to FIGS. 4 and 5 with reference to FIGS. 1–3, the locking balls 32 are initially pressed by the inner wall of the adjusting ring 31 to be secured in one of the retaining grooves 220 of the shank 22 so that the retractable handle 24 is secured on the shank 22 as shown in FIG. 2.

The adjusting ring 31 is then moved rightward on the retractable handle 24 from the position as shown in FIG. 2 to the position as shown in FIG. 4 so as to introduce the locking balls 32 into the receiving recess 310 of the adjusting ring 31 and detach the locking balls 32 from the retaining groove 220 of the shank 22, thereby releasing the retractable handle 24 from the shank 22 so that the retractable handle 24 can be moved outward relative to the shank 22 from the position as shown in FIG. 4 to the position as shown in FIG. 5 so as to lengthen and extend the length of the force arm of the shank 22 so that the shank 22 together with the retractable handle 24 can be adapted to provide a larger torque so as to facilitate the wrench body 20 of the wrench 10 operating a workpiece (not shown) which needs a larger torque, thereby increasing the versatility of the wrench 10.

As shown in FIG. 5, when the balls 32 align with another retaining groove 220 of the shank 22, the adjusting ring 31 is then moved leftward on the retractable handle 24 by means of the restoring force of the biasing member 34 to detach the locking balls 32 from the receiving recess 310, and to force the locking balls 32 into the retaining groove 220 by the inner wall of the adjusting ring 31, thereby positioning the retractable handle 24 on the shank 22 again.

It should be clear to those skilled in the art that further embodiments may be made without departing from the scope of the present invention.

What is claimed is:

1. A wrench comprising:

a wrench body;

an elongated shank mounted on said wrench body, said shank having an outer periphery defining a plurality of annular retaining grooves;

an elongated retractable handle telescopically and slidably mounted on said shank, a knurl formed on an outer periphery of said retractable handle; and an adjusting device mounted between said shank and said retractable handle for adjustably securing said retractable handle on said shank, said adjusting device including:

a plurality of locking balls each movably mounted in a first end of said retractable handle and each detachably secured in one of said retaining grooves of said shank;

an adjusting ring slidably mounted on said first end of said retractable handle and having a first end defining a receiving recess and a second end defining a chamber provided with an annular abutting flange, a knurl formed on an outer periphery of said adjusting ring, wherein, said adjusting ring is slidable on said first end of said retractable handle between a first position where each of said locking balls is pressed by an inner wall of said adjusting ring to be received in one of said retaining grooves of said shank for positioning said retractable handle on said shank, and a second position where each of said locking balls is introduced into said receiving recess of said adjusting ring to detach from said one retaining groove, thereby releasing and detaching said retractable handle from said shank such that said retractable handle is slidable on said shank, and wherein said receiving recess of said adjusting ring includes a tapered guide neck for introducing each of said locking balls into said receiving recess;

a plurality of abutting beads each secured in an outer periphery of said first end of said retractable handle and each received in said chamber of said adjusting ring;

a biasing member mounted on said retractable handle, received in said chamber of said adjusting ring and pressed between said abutting flange and said abutting beads; and a limiting ball secured in said shank and abutting said first end of said retractable handle for limiting said first end of said retractable handle.

* * * * *